United States Patent [19]

Kratochvil, Jr.

[11] 3,934,720

[45] Jan. 27, 1976

[54] SUSPENSION BOX FOR SHIPPING FURNITURE

[75] Inventor: John R. Kratochvil, Jr., Newton, N.C.

[73] Assignee: Boise Cascade Corporation, Boise, Idaho

[22] Filed: Feb. 15, 1974

[21] Appl. No.: 443,032

[52] U.S. Cl. ..... 206/326; 206/521; 229/23 BT

[51] Int. Cl.[2] ..... B65D 85/00; B65D 81/02; B65D 5/35

[58] Field of Search..... 206/814, 326, 521; 229/23 R, 23 BT

[56] References Cited

UNITED STATES PATENTS

| | | | |
|---|---|---|---|
| 1,925,298 | 9/1933 | Boeye | 229/14 |
| 2,040,241 | 5/1936 | Cortiler | 206/814 |
| 2,633,982 | 4/1953 | Addison | 206/326 |

*Primary Examiner*—George E. Lowrance
*Assistant Examiner*—Douglas B. Farrow
*Attorney, Agent, or Firm*—Lawrence E. Laubscher

[57] ABSTRACT

A suspension box member for use as a base or platform of a shipping container is disclosed. The suspension box is made of fiberboard or other material which deflects to absorb shock and other forces which would otherwise be transmitted directly to the item being shipped. The suspension box is of relatively simple design, thus making it easily adaptable for use with various types of covers for the shipping container. Such covers may be in the form of a box with an open bottom, a slotted telescope cover for rectangular items or various form-fit covers, the latter being particularly suitable for upholstered chairs.

22 Claims, 22 Drawing Figures

Fig. 4
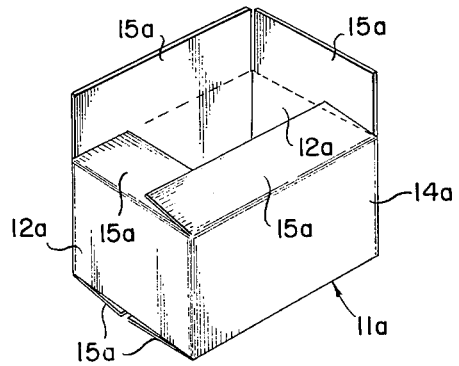
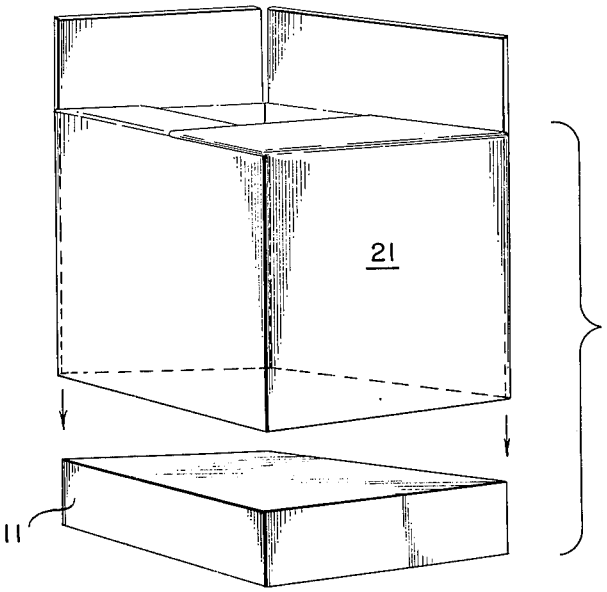
Fig. 5
Fig. 6
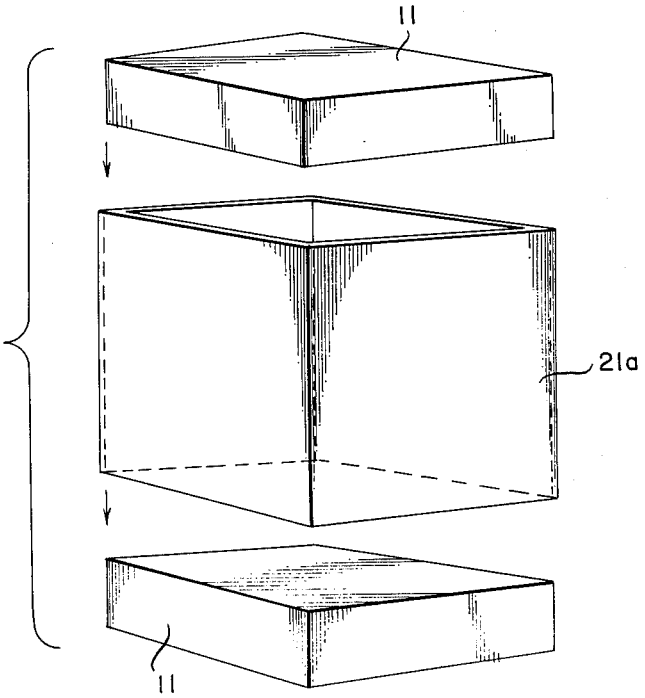

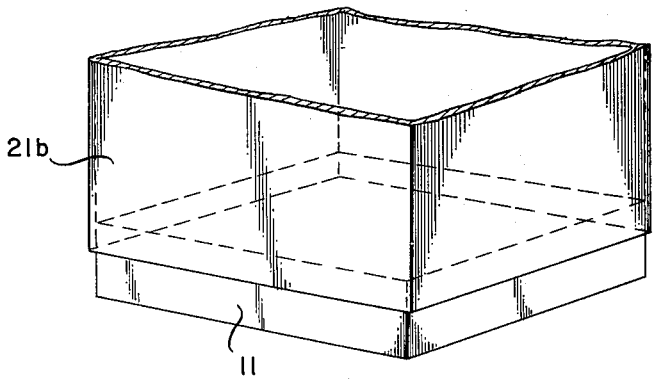
Fig. 7
Fig. 8
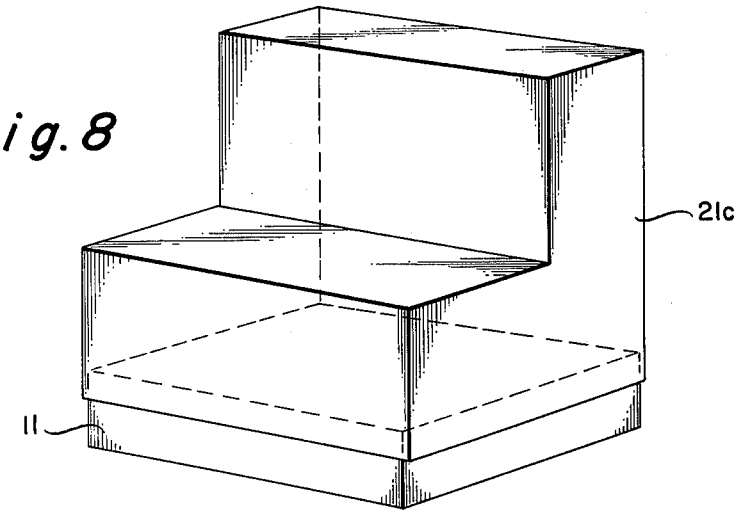
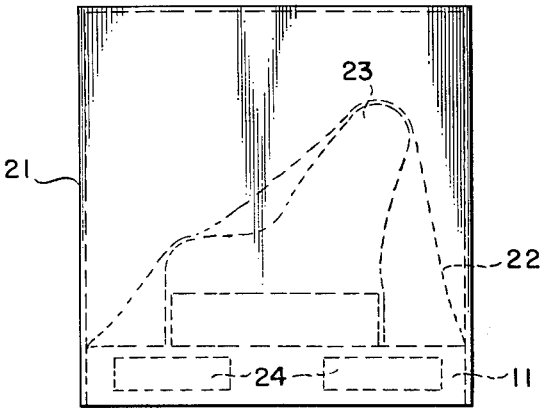
Fig. 9

Fig. 10
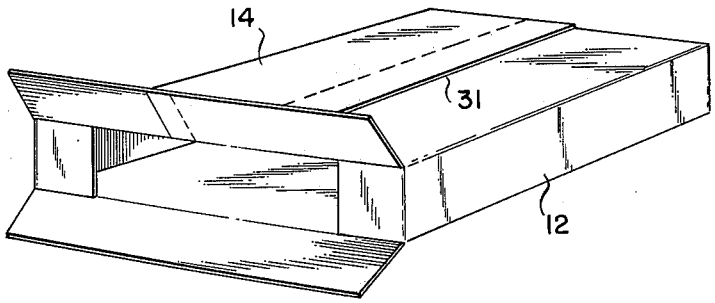
Fig. 11
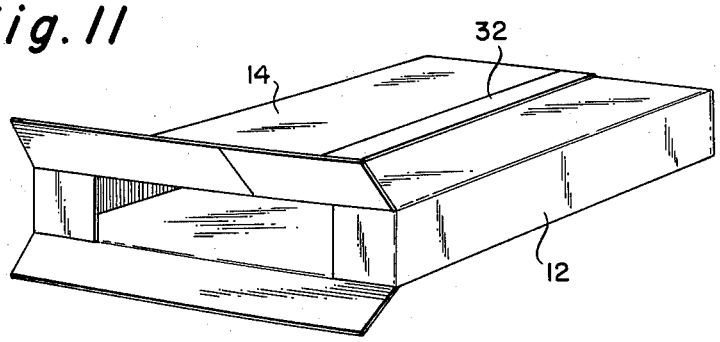
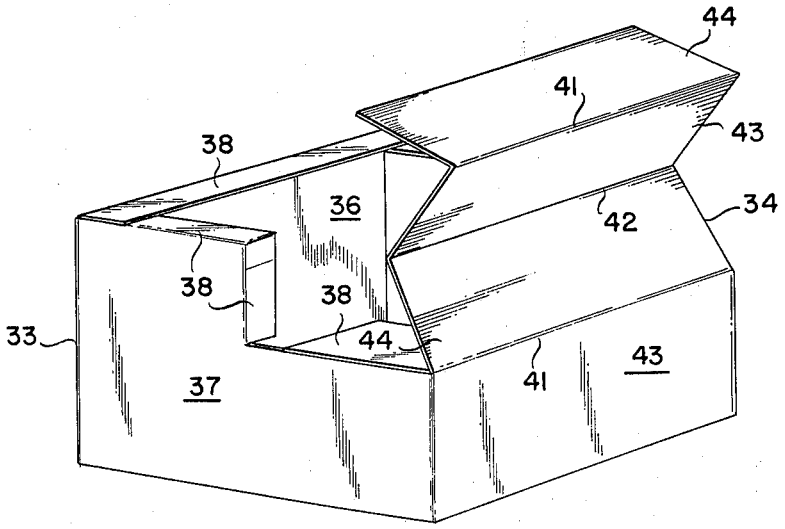
Fig. 12

Fig. 13
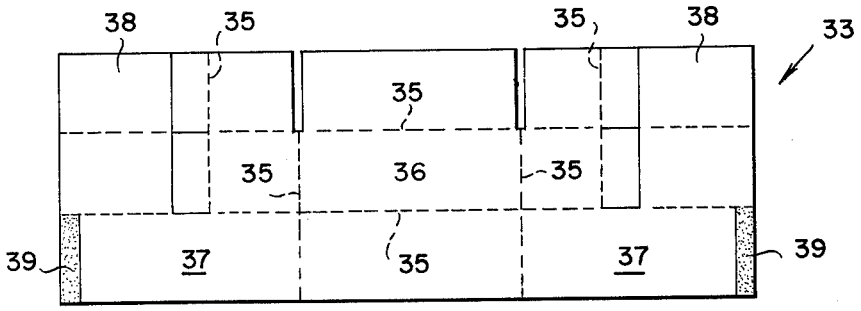
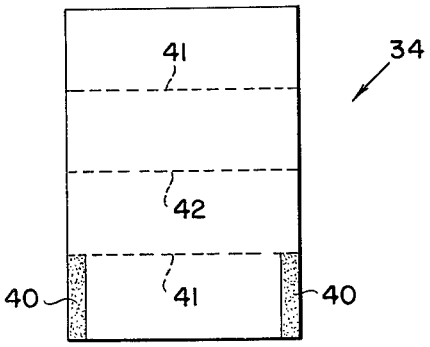
Fig. 14
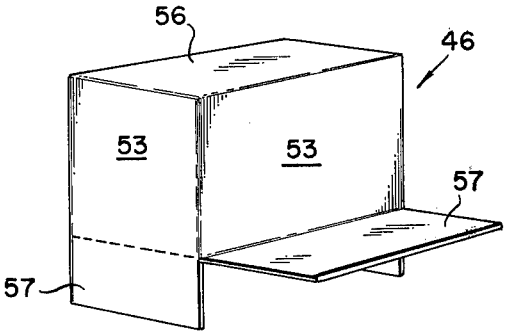
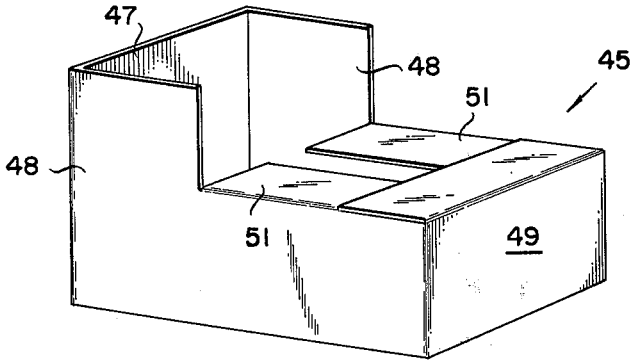
Fig. 16
Fig. 15
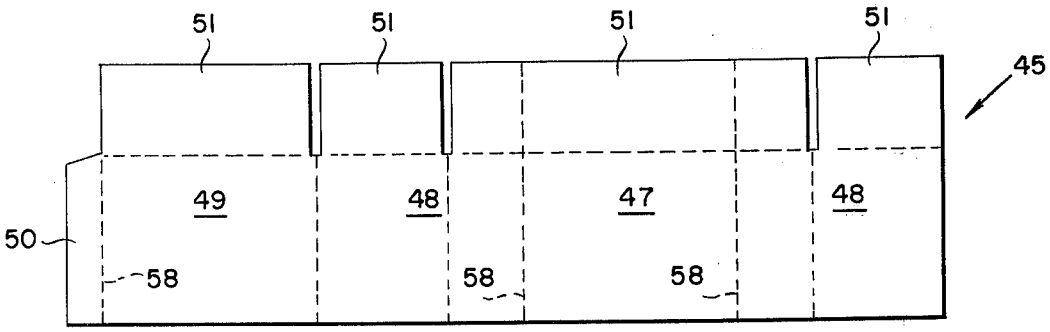

Fig. 17
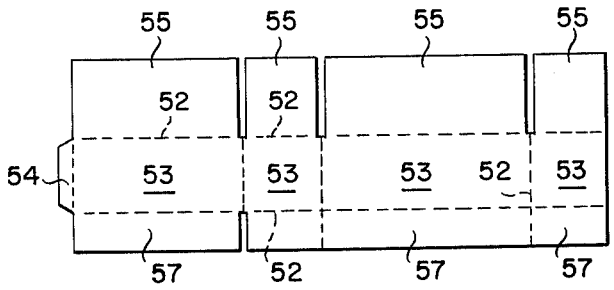
Fig. 18
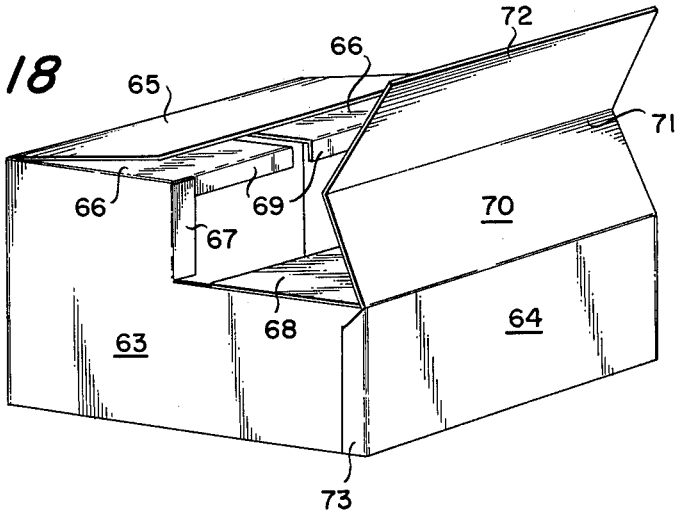
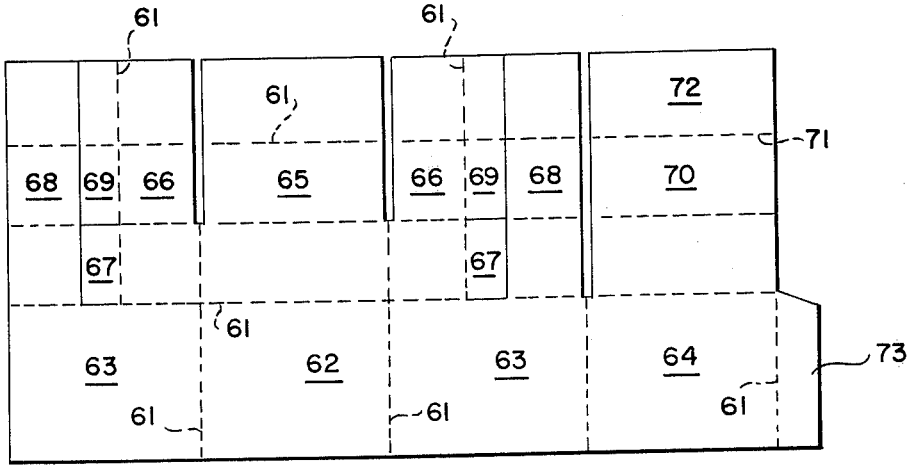
Fig. 19

Fig. 20
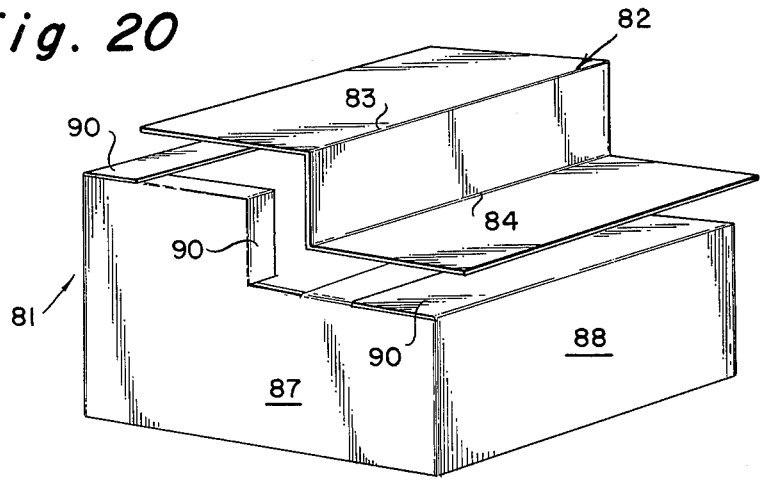
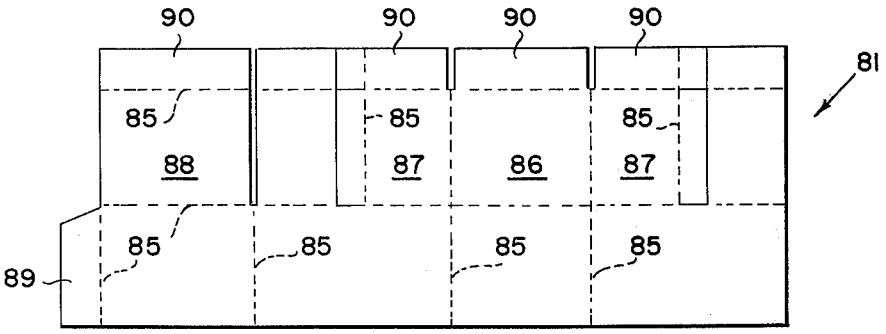
Fig. 21
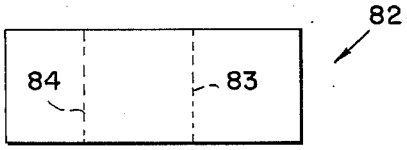
Fig. 22

SUSPENSION BOX FOR SHIPPING FURNITURE

BACKGROUND AND SUMMARY OF THE INVENTION

The present invention relates to a suspension box for use in shipping items of furniture. More particularly, the present invention relates to a suspension box in the form of a hollow box construction which forms a platform within a container which is useful in shipping furniture.

Previous containers for use in shipping chairs or other items of furniture have included such configurations as that shown in U.S. Pat. No. 3,642,127, in which a chair is attached to a support panel, which in turn is secured to the bottom of the box by means of a rail structure formed by two opposite flaps. The remaining two flaps are then employed to form the bottom of the box. In this prior art configuration, a slotted container with flaps to close the container is thus provided, and the support panel is an additional interior part which does not form the bottom of the container.

Other prior art containers employing base support units which form the bottom of the container include those such as are disclosed in U.S. Pat. Nos. 2,331,753 and 2,633,982. Each of these patents describes a base unit which supports the piece of furniture by bearing against the bottom of the front and back rails and/or side rails of the item of furniture. The legs of the item of furniture penetrate into the support base. Thus, any impact on the bottom of the container is transferred through the base into the frame of the furniture. The position of the suspension boards or holes for positioning the furniture are determined by the position of the legs on the item of furniture being packed, while the thickness of the base is determined by the length of the leg on the particular item of furniture. Such prior art construction as disclosed in these two latter patents requires that individual bases be built for each furniture frame of a different size.

By the present invention there is provided a suspension box construction which comprises an improved platform on which to attach an item of furniture to be shipped. The suspension box, which is constructed of corrugated fibergoard or other similar material, has four vertical faces, as well as a horizontal top wall and a horizontal bottom wall. The chair or other item of furniture can be packed so as to rest directly on the platform which is formed by the horizontal top wall of the suspension box. The cover for the container fits closely over the vertical faces of the suspension box and is fastened to these faces by means such as staples or adhesive to provide a complete enclosure for the item of furniture to be shipped.

Since the suspension box is made of fiberboard or other similar material, the platform face formed by the top wall of the suspension box, on which the chair, for example, rests, deflects slightly under the weight of the chair, or under the impact of the chair as the container bounces along in a truck or railcar. This deflection of the platform face cushions any shock which may be transferred into the legs of the chair during shipment, thus reducing the possibility of breaking legs or glue joints. The ability of the suspension box to absorb shock is an essential distinguishing feature of the present invention over prior art shipping containers having a bottom panel through which shock is transmitted directly to the lower portion of the article of furniture being shipped.

Thus, by the present invention, there is provided a new package construction for bulky products such as upholstered furniture or the like. A suspension box member defines a base or platform upon which the product is supported within the container. This suspension box member represents an essential distinguishing characteristic of the package construction of the present invention. A cover member may be provided to fit downwardly over the product for connection at its lower edges with the suspension box member. The cover may be of any desired construction such as a box with an open bottom or a slotted telescope cover for rectangular items. Various form-fit covers as disclosed herein may also be advantageously employed with the suspension box member of the present invention.

Included within the scope of the present invention is the use of a plurality of suspension boxes in one package construction, such as in the case where side chairs are packed two to a box, one up and one upside down, with the cover comprising a tube and suspension boxes employed as the top and bottom of the container. Also, in accordance with the present invention, the depth of the container may be varied by allowing the cover to fit only partially over the sides of the suspension box member. Other embodiments include that in which the suspension box has the item of furniture connected by a "shrink wrap," so that the item is completely suspended away from the outer walls of the container. In a further variation, the suspension box member may be employed as a compartment divider to hold various parts of the product.

BRIEF DESCRIPTION OF THE DRAWINGS

The advantages of the present invention will become more understandable from the detailed description which follows, taken in conjunction with the accompanying drawings wherein:

FIG. 4 is a second embodiment of the suspension box of the present invention;

FIGS. 5 through 8 are full or partial perspective views of alternative embodiments of containers constructed in accordance with the present invention;

FIG. 9 is an elevational view in cross-section showing one embodiment of a container constructed in accordance with the present invention;

FIGS. 10 and 11 are perspective views of alternative embodiments of the blank shown in FIG. 1;

FIG. 12 is a perspective view of a first embodiment of a form-fit cover employed with the suspension box member of the present invention;

FIGS. 13 and 14 are plan views of the blanks employed in constructing the cover of FIG. 12;

FIG. 15 is a perspective view of a second embodiment of a form-fit cover employed with the suspension box member of the present invention;

FIGS. 16 and 17 are plan views of the blanks employed in constructing the cover of FIG. 15;

FIG. 18 is a perspective view of a third embodiment of a form-fit cover employed with the suspension box member of the present invention;

FIG. 19 is a plan view of the blank employed in constructing the cover of FIG. 18;

FIG. 20 is a perspective view of a fourth embodiment of a form-fit cover employed with the suspension box member of the present invention; and FIGS. 21 and 22 are plan views of the blanks employed in constructing the cover of FIG. 20.

DESCRIPTION OF THE PREFERRED EMBODIMENTS

Figure 1:
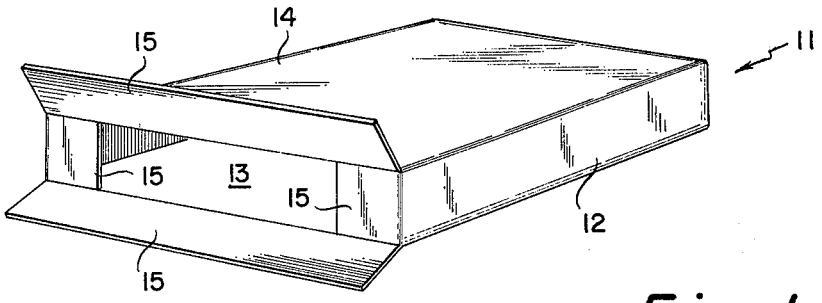
FIG. 1 is a perspective view showing the suspension box of the present invention.
Figure 2:
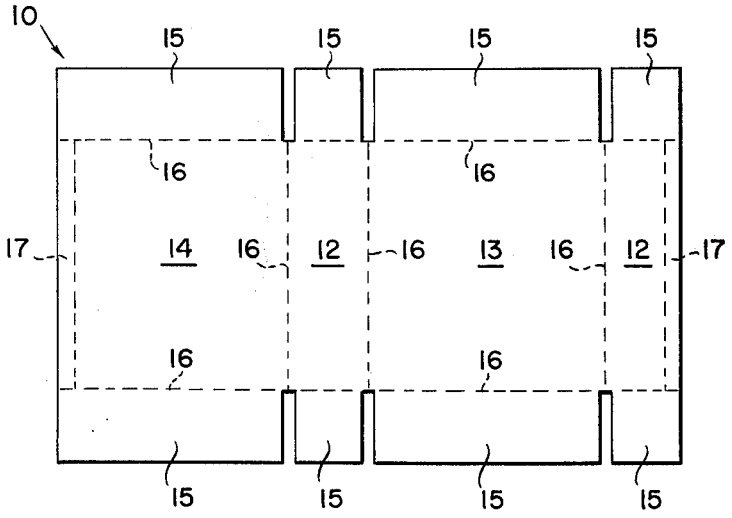
FIG. 2 is a plan view of a blank suitable for forming the walls of the suspension box shown in FIG. 1.
Figure 3:
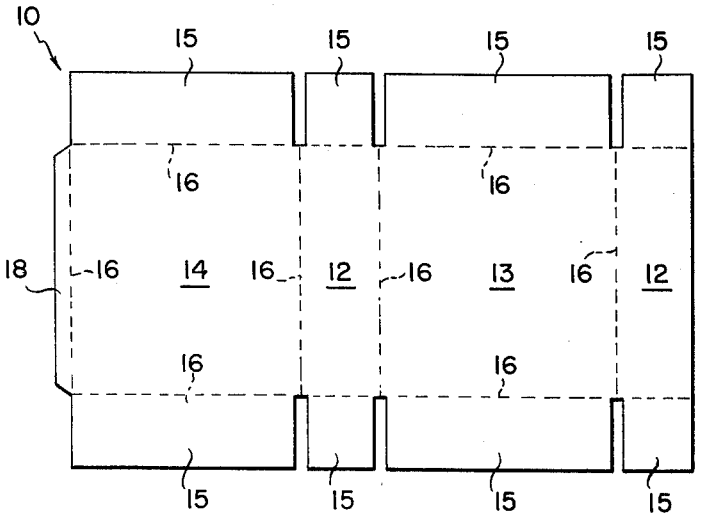
FIG. 3 is a plan view of an alternative embodiment of the blank shown in FIG. 2.

As shown in FIGS. 1 through 3, there is provided a suspension box member 11 having four vertical side walls 12, a horizontal bottom wall 13 and a horizontal top wall 14. Two of the side walls 12 are formed by flaps 15 attached to the bottom 13 and top 14 walls and the remaining two side walls 12. The item of furniture to be shipped rests on the top wall 14 and may be attached to the suspension box by straps or other suitable means.

The blank 10 shown in FIGS. 2 and 3, which can be folded to provide the suspension box member 11 of FIG. 1, is provided with score or fold lines 16 to define the side walls 12, the bottom 13 and the top wall 14. The top wall 14 is connected upon folding of the blank 10 to the side wall 12 on the opposite end of the blank 10 by means of tape 17 applied to the outer portions of the top wall 14 and side wall 12, as shown in FIG. 2. Alternatively, the connection of the top wall 14 to the side wall 12 may be made by means of a tab 18 attached to the top wall, as shown in FIG. 3. This tab 18 may be secured to the opposite side wall 12 by any suitable means such as gluing or stitching.

In FIGS. 10 and 11, there are shown alternative securing means for connecting the walls of the blank to form the suspension box 11. Thus the embodiment of FIG. 10 is provided with a stitched or glued joint 31 in the panel 14 with a suitable overlap being provided to reinforce the joint 31. The embodiment of FIG. 11 is provided with a tape joint 32 in the panel 14, and in this case no overlap is necessary due to the reinforcement provided by the tape itself. The use of a tape joint 32 has been found to be particularly useful in the case where the height of the vertical side walls 12 is relatively small.

It should be pointed out that it is not mandatory that the top wall 14 be designated as the wall to be connected to the opposite side wall 12, as the wall to be connected to the opposite side wall 12 may also serve as the bottom wall 13. Thus, the positions of the top wall 14 and bottom wall 13 as shown in FIGS. 2 and 3 may be reversed without affecting the characteristics of the suspension box member 11 of the present invention. An essential aspect of the present invention to be kept in mind is that the suspension box member 11 is constructed in a box shape as shown, of a material which will provide sufficient deflection to cushion the forces of shock to which the item of furniture may be subjected during shipment.

In the previously described embodiment of the suspension box member 11 as shown in FIG. 1, each of the flaps 15 is of a length which is equal to the height of the vertical side walls 12, forming a full overlap slotted construction. Thus the flaps 15 attached to the top 14 and bottom 13 walls will completely overlap each other. These flaps 15 may be folded one over the other and secured by suitable means such as staples to provide a closed suspension box structure. This embodiment is the preferred structure where strength and durability are required and, in addition, such a structure is easily closed by staples or other means, particularly when the height dimension of the suspension box is relatively small.

In an alternative embodiment of the suspension box member as shown in FIG. 4, the suspension box 11*a* is provided with flaps 15*a* which form opposite side walls 12*a*, with the flaps 15*a* being of a length which is equal to one-half the height of the side walls 12*a*, providing a configuration known as a regular slotted construction. Thus the flaps 15*a* which form a side wall 12*a*, will meet along a line midway of the height of the side wall 12*a*, and the outer flaps 15*a* may be secured to the underlying flaps 15*a* by staples or other suitable means. Suspension box 11*a* may also be formed from a blank, similar to that shown in FIGS. 2 and 3. Another construction which may be employed for the suspension box is that in which the flaps overlap to a limited extent, thus providing a configuration known as an overlap slotted construction.

A variety of covers may be employed with the suspension box member 11 to provide a complete container for the item being shipped. As shown in FIG. 5, the cover 21 may be in the form of a box having one open end which fits over the suspension box 11. In the embodiment shown in FIG. 6, the cover 21*a* is constructed as a tube, with suspension box members 11 positioned at either end. Such a construction is particularly suitable in the case where two chairs, for example, are shipped in a single container, with one chair being inverted and attached to the upper suspension box member 11.

FIG. 7 shows an embodiment of the present invention in which the cover 21*b* only partially covers the sides of the suspension box member 11, the cover 21*b* being secured to the sides of the suspension box member 11 by staples or other suitable means at the point along the sides which will provide the desired height for the container. In FIG. 8 there is shown a form-fit cover 21*c* for use in shipping a furniture item such as an upholstered chair.

The embodiment of the present invention which is illustrated in FIG. 9 is that in which a shrink-wrap material 22 has been employed to cover an item of furniture 23, with the shrink-wrap material 22 also being wrapped around the suspension box member 11, thus serving to secure the item 23 to the suspension box member 11. A suitable cover 21 fits down over the shrink-wrapped item 23 to provide a complete container assembly. FIG. 9 also shows the use of the suspension box member 11 as a separate shipping compartment within the container, chair cushions 24 being stored within the suspension box 11 during shipment.

In FIGS. 12 through 22 there are shown various embodiments of a form-fit cover of the general type shown in FIG. 8. In the embodiment of FIGS. 12, 13 and 14, there is illustrated a form-fit cover constructed of two blank portions 33 and 34. The blanks 33 and 34 are joined by tape joints 39 of blank 33 which are in sealing engagement with tape joints 40 of blank 34 when the cover is assembled.

The blank 33 is provided with score or fold lines 35 which define the back wall 36 and the two L-shaped side walls 37. Also defined by the score lines 35 are the flaps 38 which are folded inwardly in the assembled configuration and extend around the inner periphery of the blank 33 to provide support for attachment of blank 34. Blank 34 is provided with parallel score lines 41 and 42, with score line 42 being a reverse score line. These lines 41 and 42 fold to produce the upper and lower front wall 43 and upper and lower top wall 44 of the cover, as shown in FIG. 12. Blank 34 may be attached to the flaps 38 by suitable means such as gluing.

The cover shown in FIGS. 15, 16 and 17 is formed of blank portions 45 and 46 which together define a form-fit cover 45 with a cap 46. Blank 45 is provided with score lines 58 which fold to define a back wall 47, two L-shaped side walls 48 and a front wall 49. A tab 50 attached to the front wall 49 provides a means for connecting the front wall 49 to the opposite side wall 48, by means such as gluing or stitching. The score lines 58 also define flaps 51 which fold inwardly in the assembled configuration and extend around the inner periphery of blank 45 immediately adjacent the upper edges of the front wall 49 and that segment of each L-shaped side wall 48 which is of the same height as the front wall 49.

Blank 46, the cap portion of the cover, includes score lines 52 which fold to define the side walls 53 joined at opposite ends of the blank 46 by a glue or stitch tab 54. The flaps 55 on one side of the blank 46 fold in overlapping relationship to form the top wall 56 when sealed by glue or similar means. The flaps 57 on the opposite side of the blank 46 are folded as shown in FIG. 15 to fit down over the folded cover 45. When assembled, the flap 57 on the front of the blank 46 has its outer edge in sealing engagement with the outer edge of the flap 51 connected to the front wall 49, with the result that the top portion of the cover is completely sealed. The flaps 57 may be secured to the blank 45 by conventional securing means.

In the embodiment shown in FIGS. 18 and 19, there is provided a cover having a back-break configuration along the center of the length dimension of the cover. Referring to FIG. 19, the score lines 61 fold to define a back wall 62, two L-shaped side walls 63 and a lower front wall 64. The back wall 62 is folded at its upper end to provide a top wall 65, having a length equal to the length of the higher segment of the L-shaped side walls 63, as shown in FIG. 18. Each of the side walls 63 is folded along its upper edge to provide inwardly projecting flaps 66, 67, and 68 along the entire length of the upper edge of the L-shaped walls 63. Each of the flaps 66 and 68 is preferably of a length equal to at least one-half the width of the back and front walls 62 and 64. Thus the flaps 66 provide support along the entire length of the top wall 65. Flaps 69 fold down from flaps 66 and engage flaps 67 to provide a reinforced corner portion as shown in FIG. 18. Flaps 68 provide support for the top wall portion 70 formed by folding the upper portion of the front wall 64. A reverse score line 71 allows further bending of the top wall 70 to define upper front wall 72. The lower front wall 64 may be attached to the side wall 63 at the opposite side of the blank by means such as a tab 73. The top wall and front wall portions 70 and 72 may be attached to the respective flaps by gluing or other suitable means. When assembled, the outer edge of front wall 72 is in sealing engagement with the outer edge of top wall 65.

The embodiment of FIGS. 20, 21 and 22 is formed of blanks 81 and 82, with blank 82 having a score line 83 and a reverse score line 84 which allow the blank 82 to be folded so as to provide a one-piece top wall for the L-shaped cover. The blank 81 which provides the L-shaped configuration is folded along score lines 85 to define a back wall 86, two L-shaped side walls 87 and front wall 88. The front wall 88 may be attached to the side wall 87 on the opposite end of the blank 81 by a stitch or glue tab 89. Also defined by the score lines 85 are flaps 90 which are folded inwardly and extend completely around the inner periphery of the upper edge of the first blank portion in the assembled configuration, thus providing support for the top wall 82.

In use, the suspension box construction of the present invention allows the legs or casters of a chair or other item of furniture to bear against the platform surface of the suspension box in the same way that the chair would bear against the floor in normal use. An impact to the bottom of the container is cushioned by the deflection of the platform surface and shock to the legs is reduced. Since the position or length of the legs is not relevant to the function of the suspension box, a variety of styles and sizes of furniture may be packed on a suspension box of a given size. Thus the suspension box of the present invention provides a container base member having highly advantageous features for use in shipping and storage of furniture and other similar products.

It is thought that the invention and many of its attendant advantages will be understood from the foregoing description, and it will be apparent that various changes may be made in the form, construction and arrangement of the parts without departing from the spirit and scope of the invention or sacrificing all of its material advantages, the forms hereinbefore described being merely preferred embodiments thereof.

It is claimed:

1. A shipping container for articles of furniture and the like, comprising a. an integral hollow suspension box base unit for supporting the article, said suspension box base unit consisting of horizontal rectangular top and bottom walls and four vertical side walls, said top and bottom walls being spaced to define an open unobstructed chamber extending between said four vertical side walls;

b. a cover consisting of horizontal top and vertical side walls, said cover being open at its bottom thereby to permit said cover to be fitted downwardly over the article to a closed position in which the cover top wall is spaced from the top wall of said suspension box base unit, thereby to enclose the article of furniture, and the lower edge portions of said cover are adjacent the outer surface of the vertical side walls of said base unit; and c. means connecting the lower edge portions of said cover with the vertical side walls of said base unit;

d. at least the top wall of said base unit being imperforate and formed of a material which deflects under load, thereby to cushion the article against shock forces applied to said container.

2. A shipping container as defined in claim 1, wherein said base unit is formed of fiberboard.

3. A shipping container as defined in claim 1, wherein said base unit is formed of a side-opening container in which two of the side walls are formed by flaps attached to the remaining side walls and the top and bottom walls.

4. The shipping container of claim 3 wherein the length of each of the flaps is equal to the height of the vertical side walls.

5. The shipping container of claim 3 wherein the length of each of the flaps is equal to one-half the height of the vertical side walls.

6. The shipping container of claim 3 wherein the length of each of the flaps is greater than one-half the height of the vertical side walls but less than the height of the vertical side walls.

7. The shipping container of claim 4 wherein a tape joint is provided both in the top wall and in the flaps attached to the top wall.

8. The shipping container of claim 4 wherein a stitched or glued joint is provided both in the top wall and in the flaps attached to the top wall, and with an overlap being provided in the portions of the top wall and flaps being joined.

9. The container of claim 1, wherein the cover is in the form of a box having one open end which fits over the base unit.

10. The container of claim 1, wherein the cover is in the form of an open tube having four side walls and wherein two base units are employed, one at each end of the cover.

11. The container of claim 1, wherein there is included within the base unit a compartment for carrying a component being shipped.

12. The container of claim 1, wherein the item of furniture is attached to the base unit by a shrink-wrap material.

13. The container of claim 1, wherein the cover is in the form of an L-shaped box having an open end which fits over the base unit.

14. The container of claim 13 wherein the cover is formed of first and second blank portions, the first blank portion having score lines which define a back wall and two L-shaped side walls, and wherein the first blank portion is provided with flaps which, when folded inwardly, extend completely around the inner periphery of the upper edge of the first blank portion in the assembled configuration, the second blank portion being provided with three score lines in parallel relationship, the middle score line of which has a reverse score, the second blank portion being folded on the three score lines to define the top wall and upper and lower front walls of the cover, and with the side walls of the first blank portion being connected to the lower front wall of the second blank portion by a pair of tape joints.

15. The container of claim 13 wherein the cover is formed of first and second blank portions, the first blank portion having score lines which define a back wall, two L-shaped side walls and a front wall, and wherein the first blank portion is provided with flaps which, when folded inwardly in the assembled configuration, extend around the inner periphery of the first blank portion immediately adjacent the upper edges of the front wall and that segment of each L-shaped side wall which is of the same height as the front wall, the second blank portion being provided with score lines which define a back wall, two side walls and a front wall, together with flaps attached to the upper and lower edges of each of said four walls of the second blank portion, the flaps attached to the upper edges of each of said four walls folding together in overlapping relationship to define a top wall, the flaps attached to the lower edges of the back wall and side walls of the second blank portion extending downwardly for attachment along the sides and back wall of the first blank portion, and the flap attached to the lower edge of the front wall of the second blank portion extending horizontally outward so that its outer edge is in sealing engagement with the outer edge of the flap attached to the upper edge of the front wall of the first blank portion, with the result that the container is completely sealed.

16. The container of claim 15 wherein tab means is employed to connect the opposite ends of each blank portion.

17. The container of claim 13 wherein the cover is formed of a blank having score lines which define a back wall, two L-shaped side walls and a front wall, a flap attached to the upper edge of the back wall to define a top wall for the higher segment of the L-shaped configuration, inwardly folded flaps attached to the upper edges of the side walls to extend along the entire inner periphery of the side walls in the assembled configuration, the flaps attached to the horizontal edge of the higher and lower segments of the side walls being of a length at least equal to one-half the width of the front and back walls, the flap attached to the back wall being provided with a flap which folds downwardly to overlap the flap attached to the vertical edge of the higher segment of the L-shaped configuration, and a flap attached to the upper edge of the front wall, said front wall flap having a reverse score line and being of a size sufficient to cover the top portion of the lower segment of the L-shaped configuration and the front portion of the higher segment of the L-shaped configuration, so that the outer edge of the front wall flap is in sealing engagement with the outer edge of the flap attached to the upper edge of the back wall.

18. The container of claim 17 wherein tab means is employed to connect the opposite ends of the blank.

19. The container of claim 13 wherein the cover is formed of first and second blank portions, the first blank portion having score lines which define a back wall, two L-shaped side walls and a front wall, and wherein the first blank portion is provided with flaps which, when folded inwardly, extend completely around the inner periphery of the upper edge of the first blank portion in the assembled configuration, the second blank portion being provided with a score line and a reverse score line which define a one-piece top wall for the L-shaped cover.

20. The container of claim 19 wherein tab means is employed to connect the opposite ends of the first blank portion.

21. The container of claim 1, wherein said cover is connected to fully cover the sides of the base unit.

22. The container of claim 1, wherein said cover is connected to only partially cover the sides of the base unit.

* * * * *